US007520154B1

(12) United States Patent
Pallotti

(10) Patent No.: US 7,520,154 B1
(45) Date of Patent: Apr. 21, 2009

(54) FENDER AND QUARTER; PULLER-POPPER (FOR AUTO BODY REPAIR)

(76) Inventor: Steven Anthony Pallotti, 225 Hazelwood Ave., Pittsburgh, Allegheny, PA (US) 15202

( * ) Notice: Subject to any disclaimer, the term of this patent is extended or adjusted under 35 U.S.C. 154(b) by 0 days.

(21) Appl. No.: 11/706,449

(22) Filed: Feb. 14, 2007

(51) Int. Cl.
*B21D 1/12* (2006.01)

(52) U.S. Cl. ..... 72/458; 72/705; 72/308

(58) Field of Classification Search ..... 72/458, 72/479, 308, 705
See application file for complete search history.

(56) References Cited

U.S. PATENT DOCUMENTS 1,737,084 A * 11/1929 Hilstad ..... 72/458
1,739,488 A * 12/1929 Thayer ..... 72/308
1,775,968 A * 9/1930 Nelson ..... 72/458
1,909,284 A * 5/1933 Kuhn ..... 72/458
2,191,720 A * 2/1940 Meinhardt ..... 72/458
2,852,971 A * 9/1958 Macaluso, Jr. ..... 72/458
4,823,589 A * 4/1989 Maxwell et al. ..... 72/457
4,924,056 A * 5/1990 Bevilacqua ..... 219/98
5,331,837 A * 7/1994 Stuhlmacher, II ..... 72/458

* cited by examiner

*Primary Examiner*—David B Jones
(74) *Attorney, Agent, or Firm*—Clifford A. Poff

(57) ABSTRACT

A repair apparatus for a vehicle has first and second telescoping pipes clamped to present a coupling part at elevated position and at a lateral position selected for restoring a damaged body portion of a vehicle. A leverage bar is secured to a receptacle joined by a hinge pin to each of the coupling parts of both telescoping pipes. A puller or one of popper heads of differing length is an attachment mounted by a hinge pin to the receptacle at spaced relation from the first hinge pin whereby a force excreted on the leverage bar simultaneously moves the quarter puller or popper head in a direction for restoring the damaged body portion of the vehicle. The position of the puller on the receptacle can be changed by removal of a hinge pin located between the puller and the leverage bar. The first telescoping pipes fit in a larger pipe welded to a plate that is either position under a tire or secured to the tire by a chain.

9 Claims, 5 Drawing Sheets

50
22
68
48
26
10
30
24
28
33
17

18
70
20
16
4
3
7
5
6
2C 5
5
50
22
12
68
13
48
15
28
26
30
33
41
20
14
16
18
4
7
T

5
T
5
7
5
7

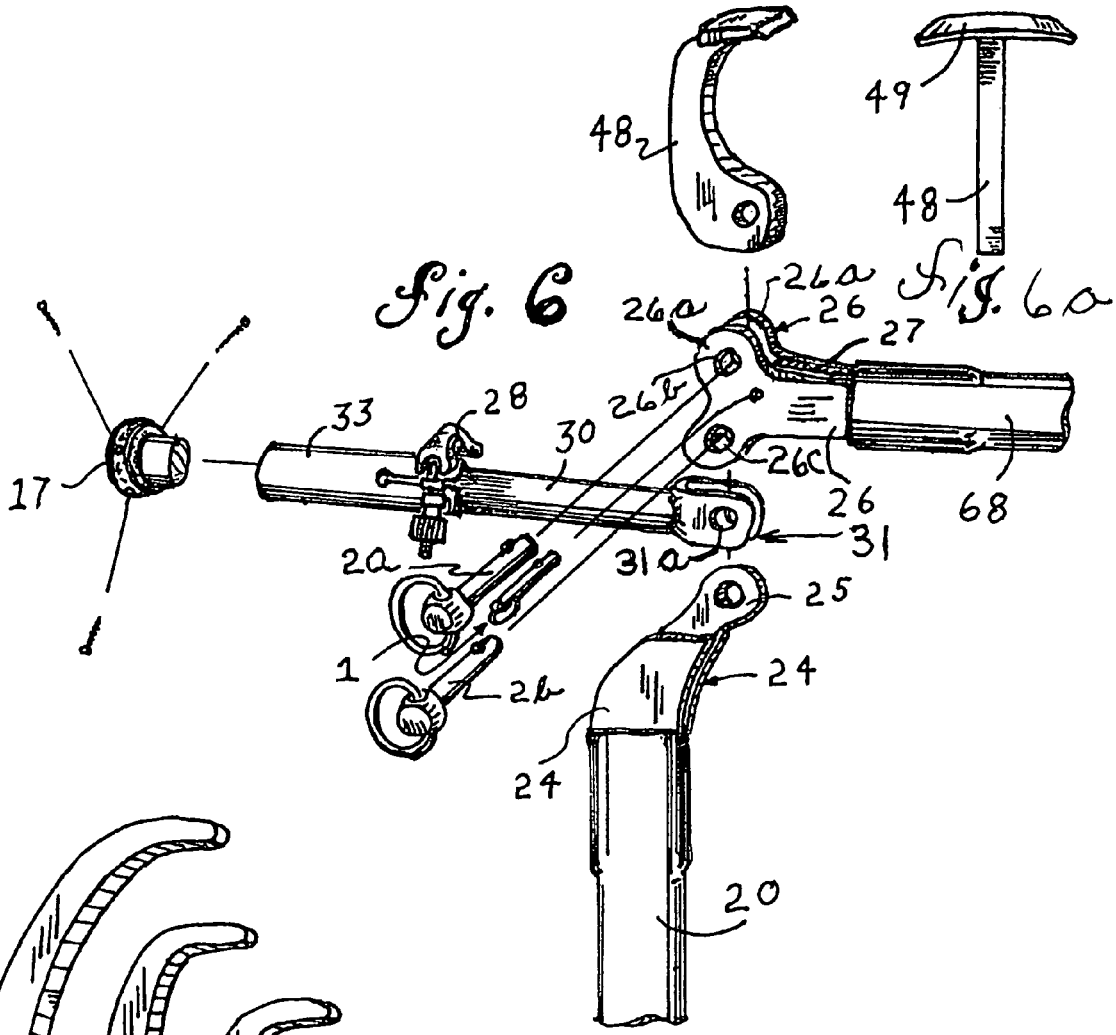
Fig. 6
Fig. 6a
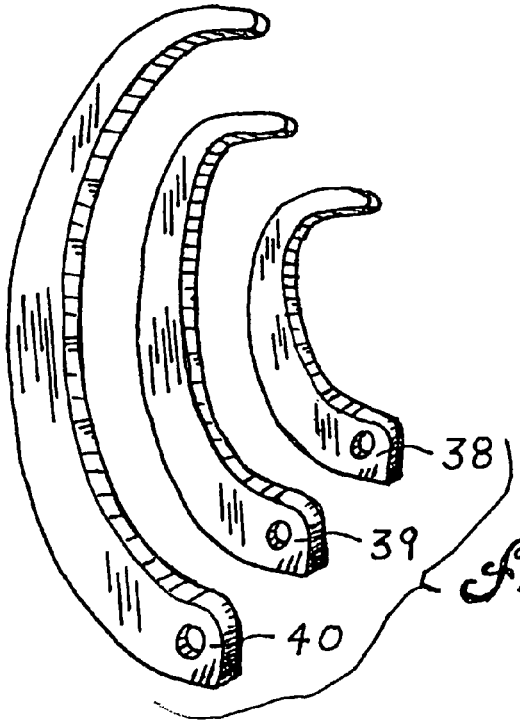
Fig. 7

FENDER AND QUARTER; PULLER-POPPER (FOR AUTO BODY REPAIR)

FIELD OF INVENTION

This invention relates to apparatus for use in the repair of vehicles, more particularly to dent pullers and frame straightening apparatus that can be assembled to customize the apparatus to a variety of tasks.

BACKGROUND OF THE INVENTION

In the past, a number of attempts have been made to remove dents from automobile bodies. It has been the usual procedure in the repair of vehicles that have suffered damage in collisions to pull out dents and other parts of vehicles that have been subject to impact to a position for finishing the finish repair. For many years workman have attached a stud to a body panel, usually by welding it onto a panel. Thereafter, a weight slidable against an end stop upon a shaft connected to the stud is used to hammer the bent part outwardly and thereby pull a fender back into shape.

U.S. Pat. No. 4,924,056 discloses the use of a slap hammer which includes a stud welding gun to a stud and weld it to the dent. An integral hammer means applies a force to the stud straighten the dent.

U.S. Pat. No. 4,823,589 provides an automotive frame straightening apparatus and method which includes a bench having a low profile with retractable lifts which permit the bench to be positioned substantially flat on the ground so that a vehicle can be driven over it. Frame machines also employ a pulling tower in that a chain is connected to a clamping device to hook at quarter panel location as the outward force is exerted for the straightening operation.

These and other prior art references are complete and functional for their intended use. However, each has inherent drawbacks which the present invention addresses. One example is the need for a large tower that is connected to a quarter panel by a clamp and a hook. Much force is exerted in an uncontrolled manner by hydraulics and injury could occur should the clamp or hook slip off the panel. Further the present invention allows the operator to control and safely apply the force needed to pull the dent in the panel is outwardly.

The prior art use of a slap hammer necessitates the need to weld a stud to the dent in the panel and then screw the tip of the slap hammer onto the stud. The impact force generated by sliding the hammer toward the operator against a stop is used to restore the dented area of the panel. However, a dangerous condition can occur if the tip slips off or breaks the stud causing the tool to quickly exit the panel. The present invention eliminates this danger.

SUMMARY OF THE INVENTION

It is there for a primary object of the present invention to provide a puller apparatus which eliminates the need for a frame machine with a pulling tower connected to the quarter panel by clamp.

A further object is to provide apparatus to pull dents without the need for welding a stud to a damaged panel surface and use of a slap hammer.

Another object of the present invention is to provide a new apparatus for use by the auto body technician to pull dents in a quarter panel without the use of a stud and slap hammer and pull quarter panels without the use of a frame machine including a pulling tower connected to the quarter panel by a clamp or a hook.

Another object of the invention is to provide an apparatus that is easily carried throughout the shop and quickly set up to pop a dent or pull a quarter panel.

Still another important object is to provide controlled pulling by means of a leverage arm that enables the operator to exert enough force to pull to the dented part or quarter panel to a position for finishing the repair to the vehicle.

BRIEF DESCRIPTION OF DRAWINGS

This invention, the manner of making it and using it, will be more fully understood by reference to the accompanying drawings of which:

FIG. 6 is an exploded view of a leverage bar, a puller, a horizontal telescopic extension, three hitch pins and a vertical telescopic extension forming part of the apparatus shown in FIG. 1;

FIG. 6*a* illustrates an enlarged front view of a puller;

FIG. 7 illustrates three dent popper attachments for use in the apparatus of the present invention;

DETAILED DESCRIPTION OF THE INVENTION

Figures 1, 2:
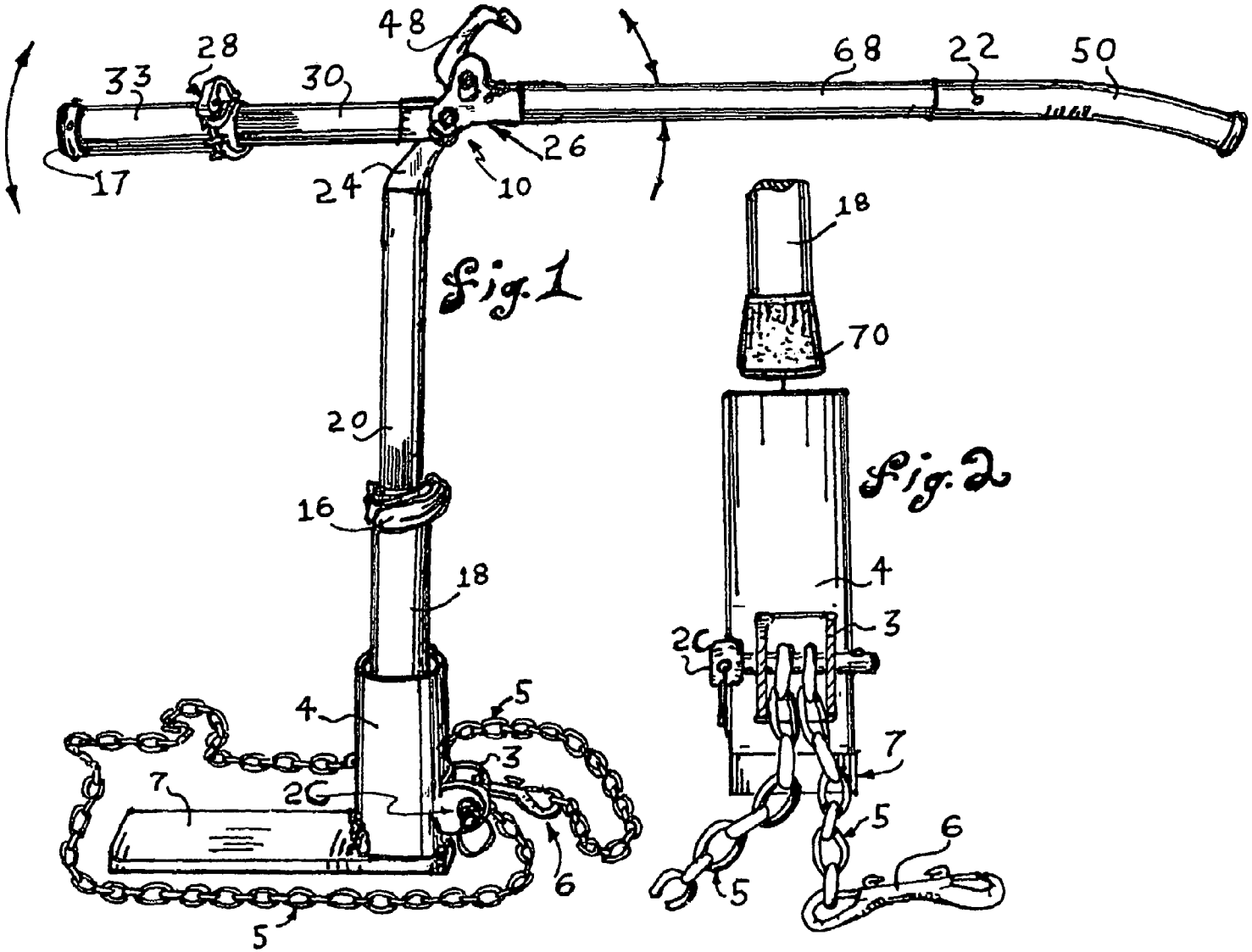
FIG. 1 is a perspective view of the apparatus in accordance with the invention.
FIG. 2 is a rear view of the bottom portion of the apparatus shown in FIG. 1.

In FIGS. 1-10 the apparatus 10 for use in the repair of a vehicle according to the invention includes first telescoping pipes 18 and 20 connected by a quick releasable clamp 16 to present a first coupling part 25 on an extended pipe end of pipe 20 to an elevated position selected for restoring a damaged body portion of a vehicle. Second telescoping pipes 30 and 33 connected by a quick releasable clamp 28 to present a second coupling part 31 on an extended end of pipe 30 to lateral position selected for restoring a damaged body portion of a vehicle. A leverage bar 28 includes a receptacle 26 forming a third coupling part joined by a first hinge pin 2*a* to each of the first coupling part 25 and the second coupling part 31. A puller 48 or popper head 38, 39 or 40 is an attachment mounted by a second hinge pin 2*b* to the receptacle 26 at spaced relation from the first hinge pin 2*a* whereby a force excreted on the leverage bar 68 simultaneously moves the quarter puller 48 or popper head 38, 39 or 40 in a direction for restoring the damaged body portion of the vehicle. The arrangement being such that the first telescoping pipes and the second telescoping pipes resisting a force execreted by downward movement of the leverage bar 68 through the first hinge pin 2*a* while simultaneously moving the puller or popper head by the second hinge pin 2*b* in a direction for outwardly restoring the damaged body portion of the vehicle.

Figure 8:
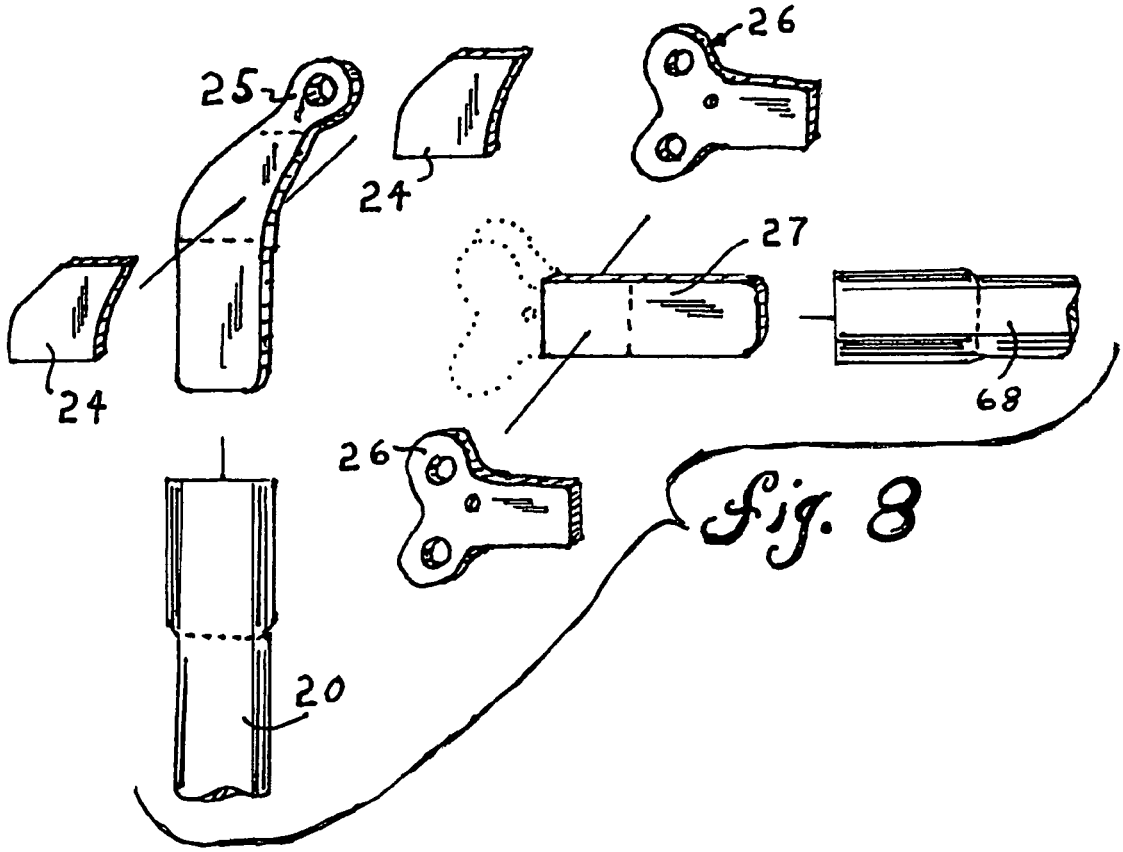
FIG. 8 is an exploded view of hinged connection between the leverage bar and the vertical telescopic extension.

Referring now particularly to FIGS. 1 and 6, the vehicle repair apparatus 10 is shown according to the preferred embodiment of the present invention. The vehicle repair apparatus 10 uses the receptacle 26 to interconnect the leverage bar 68 with the quarter puller 48. The leverage bar 68 includes an extension handle 50 secured by a compressible button lock 22. As shown in FIG. 8 a steel plate 27 is welded into pipe section 68 and receptacle plates 26*a* are welded to apposite sides of the steel plate 27. Also receptacle 25 is a steel plate welded into the pipe section 20 and steel plates 24 are welded to opposite sides of the receptacle 25 as shown. A hitch pin hole 26*b* located in the top of the receptacle 26 is used to secure a quarter puller 48 and a hitch pin hole 26*c* located in the bottom of the receptacle 26 is used to secure the flanged end 24 attached to the vertical extension pipe 20. The pipe 18 that is adjustable by the quick release clamp 16 also fits inside pipe section 4. Welded to pipe section 4 is a steel plate 7 that mounts under the tire T. Welded to the pipe section 4 is a chain mounting bracket 3 secured to a chain 5 by a hitch pin 2*c*. A double chain snap hook 6 is provided to adjust tension in the chain.

Figures 3, 4, 5:
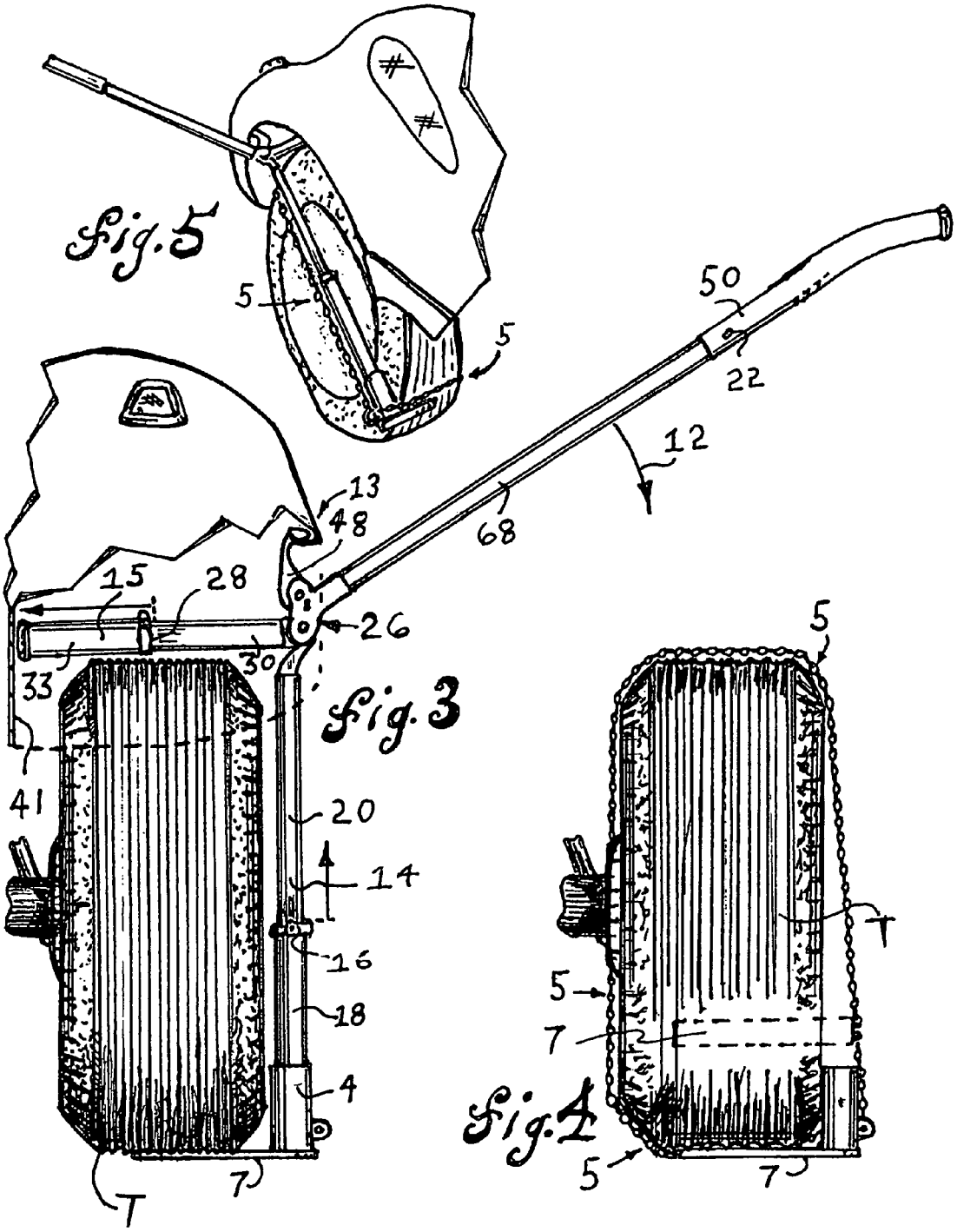
FIG. 3 is a side view of the apparatus shown in FIG. 1 for pulling quarter panel outwardly.
FIG. 4 is a side view showing an alternative use of a chain secured to a tire for supporting the apparatus of the present invention to repair the damage to the lower quarter panel.
FIG. 5 is an isometric illustration of the alternative use of a chain as shown in FIG. 4.

FIG. 6 shows details of the second telescoping pipes 30 and 33 connected by a releasable clamp 28 to present a second coupling part 31 having the form of spaced parallel plates 31*a* welded to the end of pipe 30 and secured to the receptacle 26 by hitch pin 2*a*. A rubber tip 17 is attached by screws 17*a* to a small piece of pipe 17*b* that is inserted into the end of pipe 33 to provide a grip to the inner uni-body of wheel well 41 as seen in FIG. 3. As illustrated in FIG. 3 pipe section 4 does not use the chain 5 when the tire is located on the steel plate 7 because the vehicle weight is sufficient to stabilize the vertical telescopic section formed by the first telescoping pipes 18 and 20. Also the vertical height adjuster formed by the quick releasable clamp 16 in the direction of arrow 14 allow adjustments to the vertical height so that the quarter puller 48 is in a position at the location of the panel damage and the horizontal telescopic assembly formed by the second telescoping pipes 30 and 33 connected by a quick releasable clamp 28 is in position for pulling by quick release clamp 28. Pipe section 33 is moved outward, in the direction indicated by arrow 15, against the inner uni-body 41. The vertical and horizontal telescopic pipe is now ready to absorb the pressure of force that is exerted downward, as indicated by arrow 12, by operation of the leverage bar 68, simultaneously causing the quarter puller 48 to pull the quarter panel outward.

FIG. 4 shows the chain 5 fixed in position around the tire T at a location where the tire has flattened area because of the weight of the vehicle on the plate 7. As the tire is turned the flattened area expands causing the chain to have more tension around the tire and fit more snuggly. FIG. 5 shows the apparatus in use for pulling a quarter panel. The location of the damage is at the lower portion toward the back of the vehicle and therefore the chain 5 is in use to further maintain the stability of the telescopic position of the apparatus for the vehicle repair.

Figure 9:
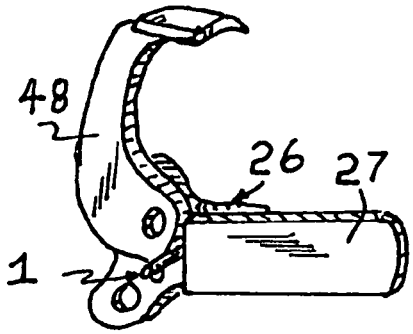
FIGS. 9 and 9*a* illustrate alternative positions of the puller and hinged connection to the leverage bar hinge and a puller.
Figure 9A:
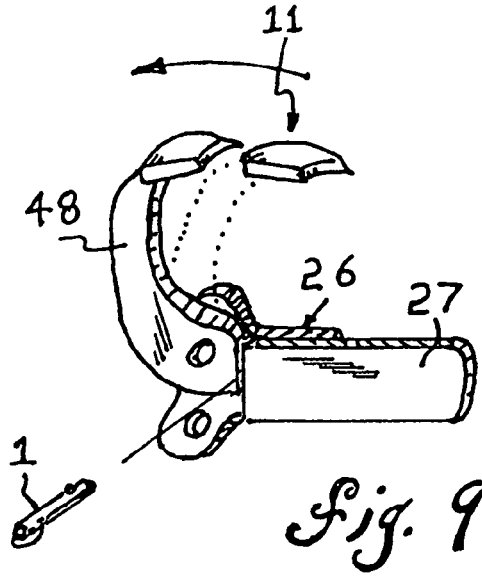

Depending on the severity of damage or how deep the quarter panel is pushed inwardly the operator may need to move the puller head as shown in FIGS. 6, 8, 9 and 9*a*. Hitch pin 1 is in a position where it extends through a hitch pin hole 26*d* in the receptacle 26 traversing a gap at the terminal end of a steel plate 27 that is welded to the receptacle plates 26*a*. When the hitch pin 1 is seated in a space at the terminal end of a steel plate 27 the puller 48 is caused to lean towards the operator for less outward pushing against the quarter panel. Hitch pin 1, as shown in FIG. 9*a* is pulled out of the receptacle 26 which allows the puller 48 to fall in the direction of arrow 11 for the deeper or greater outward pushing against the quarter panel. FIG. 6*a* shows an enlarged front view of the puller 48 having a puller head 49 with a slight bend to provide a relaxed fit in quarter panel lips as seen in FIG. 3.

Figure 10:
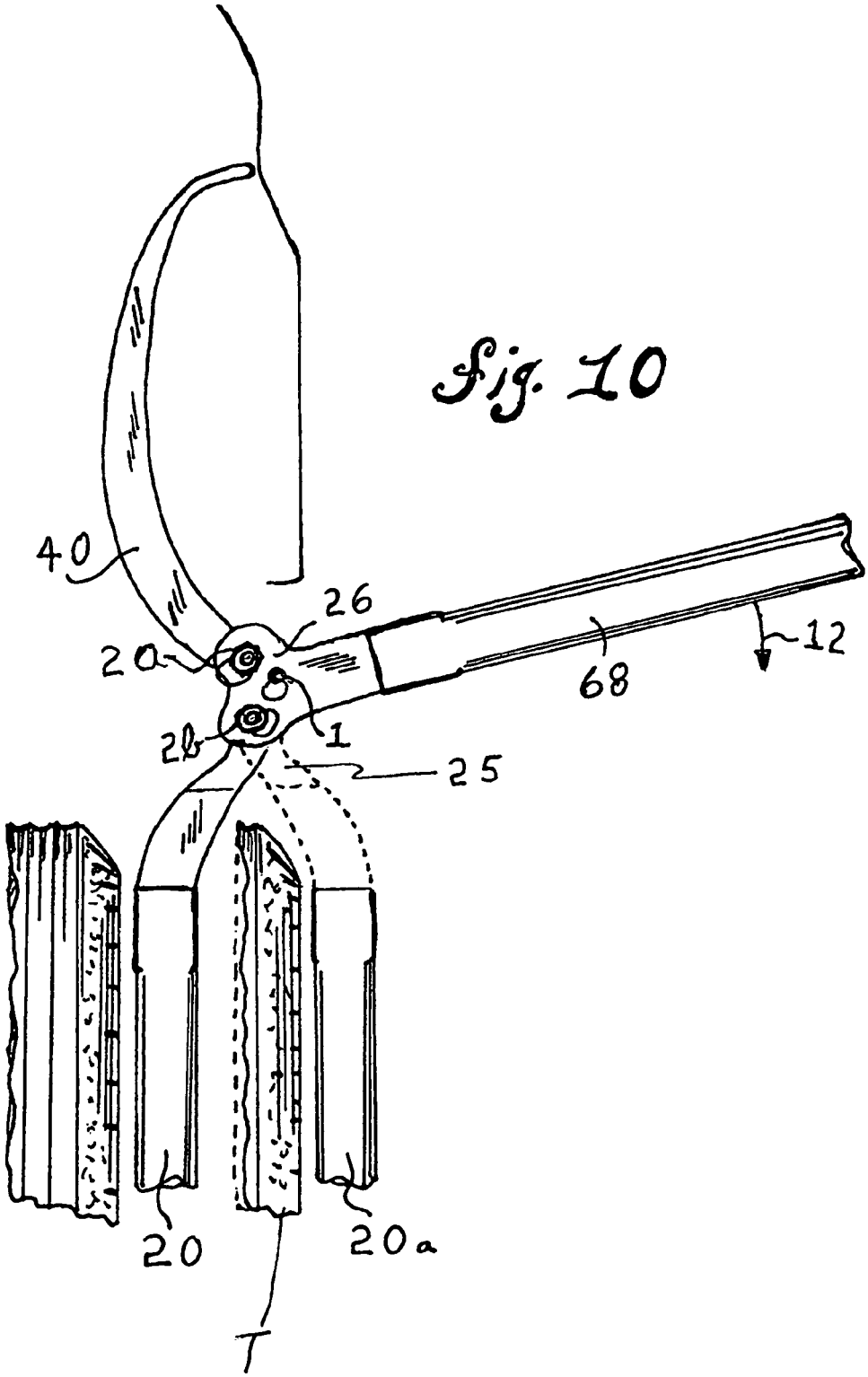
FIG. 10 illustrates a dent popper shown in FIG. 7 and a related vertical telescopic extension.

Referring to FIG. 10 a second alternate embodiment of the present invention is shown. In this embodiment the dent poppers 38, 39 and 40 shown in FIG. 7 are used. The poppers are made in three different lengths, namely popper 38 is 5", popper 39 is 9" and popper 40 is 13" long. This enables the operator to select the length needed to pop out the dent. FIG. 10 also shows the apparatus in use without the horizontal extension. At the operators discretion there is less pressure to be absorbed at times with a fender dent. Also if needed the operator may reverse the vertical extension, 20, by removing hitch pin 2*b* at the first coupling part 25 reposition the first telescoping pipes 18 and 20 as shown at 20*a* and then replacing the hinge pin 2*b* for a deeper pull.

There are many advantages to this apparatus that are disclosed herein. It is easily carried throughout the shop by the technician and has a quick set up. It is simple to operate and enables the operator the convenience of the leverage handle 68 to control the force exerted as well as the visual needed to pull or pop the quarter panel or fender.

As shown and described above this apparatus can only be preferred over the present invention. Features from other embodiments can be mixed to produce further embodiments. It will be manifest to a person skilled in the art of auto body repair and therefore makes numerous alterations and rearrangements of the parts without departure form the sprit and scope of the underlying invention and that the same is not limited to the particular forms.

What I claim as my invention is:

1. Apparatus for use in the repair of a vehicle, said apparatus comprising:

first telescoping pipes connected by a releasable clamp and supported at a fixed position to present a first coupling part on an extended pipe end to an elevated position selected for restoring a damaged body portion of a vehicle;

second telescoping pipes connected by a releasable clamp to engage an inner body of a wheel well and present a second coupling part on an extended end to a lateral position selected for restoring said damaged body portion of a vehicle;

a leverage bar joined to a receptacle forming a third coupling part joined by a first pin to each of said first coupling part and said second coupling part; and a puller or popper head attachment mounted by a second pin to said receptacle at spaced relation from said first pin, said first telescoping pipes and said second telescoping pipes resisting a force excreted by downward movement of said leverage bar through said first pin while simultaneously moving said puller or popper head by said second pin in a direction for outwardly restoring the damaged body portion of the vehicle.

2. The apparatus according to claim 1 further including a hitch pin selectively inserted into a hitch pin hole located in said receptacle to allow said puller or popper head to move to a position for a greater pull of the damaged body portion of a vehicle.

3. The apparatus according to claim 1 further including a pipe section secured to a plate for restraining said first telescoping pipes at a fixed position relative to a vehicle tire at the damaged body portion of the vehicle.

4. The apparatus according to claim 3 further including a chain for attaching said pipe section to said vehicle tire.

5. The apparatus according to claim 3 wherein said plate mounts under said vehicle tire.

6. The apparatus according to claim 1 wherein said puller includes a puller head with a slight bend to be placed in the lip of a quarter panel when such a quarter panel is pulled outwardly.

7. The apparatus according to claim 1 wherein said popper head attachment includes one of plurality of popper heads having differing lengths for popping fender dents outward.

8. The apparatus according to claim 1 wherein said first telescopic pipes are constructed to reversible present said first coupling part at said elevated position for changing said elevated position.

9. The apparatus according to claim 1 wherein said second telescoping pipes are extendable by operation of said quick release clamp to present an end portion against an inner uni-body of the damaged body portion of said vehicle.

* * * * *